US007968133B2

(12) United States Patent
Dal et al.

(10) Patent No.: US 7,968,133 B2
(45) Date of Patent: Jun. 28, 2011

(54) ELEMENT FOR PRODUCING A PACKAGE FOR PACKAGING A FOOD PRODUCT, CORRESPONDING PACKAGE, ASSEMBLY COMPRISING SUCH A PACKAGE AND A FOOD PRODUCT, CUTTING INSTALLATION AND METHOD

(75) Inventors: Sylvain Dal, Dunkirk (FR); Jean-Claude Weber, Bondy (FR)

(73) Assignee: Fromageries Bel, Paris (FR)

( * ) Notice: Subject to any disclaimer, the term of this patent is extended or adjusted under 35 U.S.C. 154(b) by 9 days.

(21) Appl. No.: 12/178,198

(22) Filed: Jul. 23, 2008

(65) Prior Publication Data

US 2008/0276569 A1 Nov. 13, 2008

Related U.S. Application Data

(62) Division of application No. 11/995,540, filed as application No. PCT/FR2006/001691 on Jul. 11, 2006.

(30) Foreign Application Priority Data

Jul. 13, 2005 (FR) ..... 05 07545
Jul. 13, 2005 (FR) ..... 05 07546

(51) Int. Cl.
*B65D 75/58* (2006.01)

(52) U.S. Cl. ..... 426/123; 426/122; 426/130; 426/115; 229/87.05; 229/87.08; 229/240

(58) Field of Classification Search ..... 229/87.05, 229/87.08; 426/115, 122, 123, 130
See application file for complete search history.

(56) References Cited

U.S. PATENT DOCUMENTS

| | | | | |
|---|---|---|---|---|
| 3,412,927 | A * | 11/1968 | Baur | 229/87.05 |
| 4,801,075 | A * | 1/1989 | Weber et al. | 229/87.05 |
| 2006/0275531 | A1 | 12/2006 | Dal | |

FOREIGN PATENT DOCUMENTS

| | | | |
|---|---|---|---|
| CH | 441 110 | A | 7/1967 |
| DE | 299 03 463 | U1 | 6/2000 |
| EP | 0 222 705 | A2 | 5/1987 |
| FR | 1 019 809 | A | 1/1953 |
| FR | 2 362 765 | A | 3/1978 |
| FR | 2 597 436 | A | 10/1987 |
| FR | 2 597 441 | A | 10/1987 |
| FR | 2 854 388 | A | 11/2004 |
| FR | 2 854 391 | A | 11/2004 |

* cited by examiner

*Primary Examiner* — Rena L Dye
*Assistant Examiner* — Chaim Smith
(74) *Attorney, Agent, or Firm* — Young & Thompson

(57) ABSTRACT

The invention concerns an element including: 1 sheet (1) including an intermediate zone (29) located between two zones designed to form side walls (9, 11), the intermediate zone (29) being designed to form a flap folded along the tip against one first (9) of the side walls, and elements (51*a*, 51*b*) for guiding tears in the sheet (1) the elements forming a single pull tab (58) to cause tears, the pull tab (58) being, in the intermediate zone, spaced apart from the media axis (A) of the zone designed to form the base (3). The invention is, for example, applicable to packaging of melted cheese.

13 Claims, 4 Drawing Sheets

ELEMENT FOR PRODUCING A PACKAGE FOR PACKAGING A FOOD PRODUCT, CORRESPONDING PACKAGE, ASSEMBLY COMPRISING SUCH A PACKAGE AND A FOOD PRODUCT, CUTTING INSTALLATION AND METHOD

CROSS-REFERENCE TO RELATED APPLICATIONS

The present application is a divisional of co-pending application Ser. No. 11/995,540, filed Jan. 14, 2008, which is the 35 U.S.C. 371 National Stage of international application no. PCT/FR2006/001691, filed Jul. 11, 2006, which claims priority to French application nos. 05/07545 and 05/07546, filed Jul. 13, 2005. The entire contents of the above-referenced applications are hereby incorporated by reference in their entirety.

FIELD OF THE INVENTION

According to a first aspect, the present invention relates to an element for producing a package for packaging a food product, the element being of the type comprising:

- a sheet which itself comprises:
  - a zone which is intended to form a substantially triangular base, the zone which is intended to form the base having a centre axis,
  - two zones which are intended to form two lateral walls which meet each other at a tip,
  - a zone which is intended to form a projection opposite the tip,
  - an intermediate zone between the two zones which are intended to form the lateral walls, the intermediate zone being intended to form a flap which is folded along the tip against a first of the lateral walls,
  - means for guiding tears in the sheet, the guiding means extending substantially along lateral edges of the zone which is intended to form the base, the guiding means forming a single traction tongue in order to bring about tears, the traction tongue extending through the intermediate zone and protruding beyond the sheet.

The invention is used in particular for packaging soft cheese.

In the remainder of the text, packages having substantially triangular bases are intended to refer to packages whose bases are effectively triangular with rectilinear sides, but also those whose bases have a curved side and are therefore in the shape of a disc sector.

BACKGROUND OF THE INVENTION

FR-2 597 441 describes an element of the above-mentioned type for packaging a portion of soft cheese. In this element, the traction tongue extends in the intermediate zone along the centre axis of the zone which is intended to form the base of the package.

Although the opening of the package described in this document is on the whole satisfactory, the initiation and propagation of the tears require traction in two different directions.

The traction of the tongue is carried out a first time towards the tip and the second lateral wall of the package in order to unfold the flap in which the traction tongue is located. After this flap has been unfolded, the traction is produced a second time towards the base of the package and the projection in order to initiate and propagate the tears.

An action of this type is considered to be complex and difficult to implement by some consumers.

SUMMARY OF THE INVENTION

An object of the first aspect of the invention is therefore to overcome this problem by providing an element of the above-mentioned type which facilitates the opening of a package for packaging a food product.

To this end, the first aspect of the invention relates to an element for producing a package for producing a food product.

According to specific embodiments, the element may comprise one or more of the features recited in dependent claims.

The first aspect of the invention also relates to a package for packaging a food product.

According to variants, the package may have the features recited in dependent claims.

The first aspect of the invention further relates to an assembly including a package and a food product packaged therein.

According to a variant, the food product is soft cheese.

BRIEF DESCRIPTION OF THE DRAWINGS

The invention will be better understood from a reading of the following description, given purely by way of example and with reference to the appended drawings, in which.

DETAILED DESCRIPTION OF THE INVENTION

Figure 1:
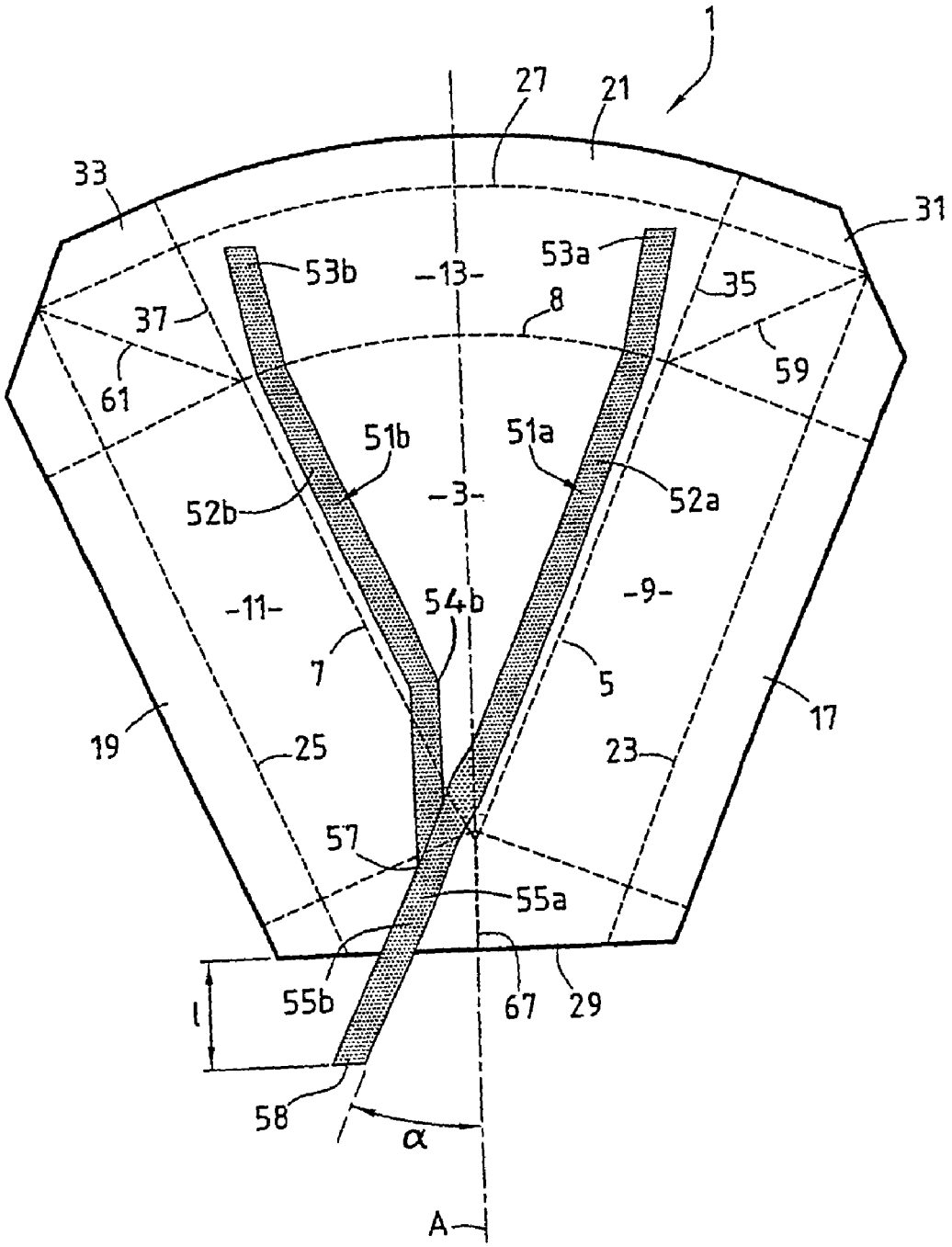
FIG. 1 is a schematic plan view of a packaging element for packaging soft cheese.

The sheet 1 illustrated in FIG. 1 is a sheet which is intended for packaging a portion of soft cheese having a base in the form of a disc sector. The sheet 1 is, for example, produced from aluminium covered with heat-sealing lacquer.

Figure 2:
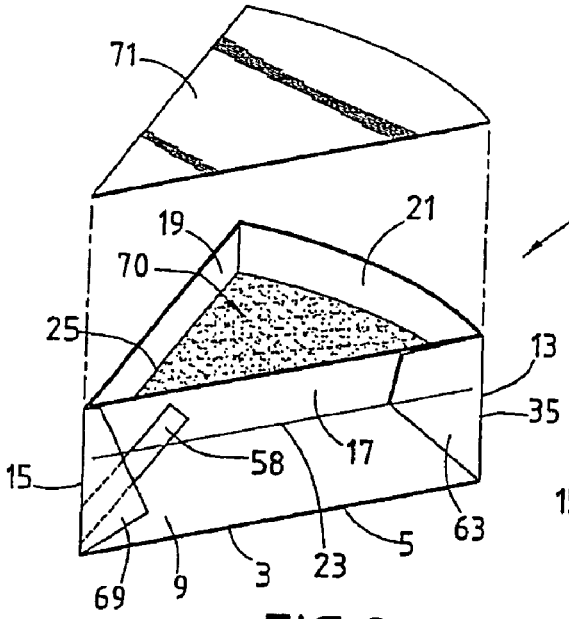
FIG. 2 is a schematic perspective illustration of a step for producing the package from the element of FIG. 1.

In order to form a package, and as illustrated in FIG. 2, the sheet 1 is shaped in the form of a receptacle 2 by means of folding along the dashed lines in FIG. 1.

The sheet 1 comprises zones which are intended to form the different portions of the receptacle 2. These different portions will be described below. The same references will generally be used to refer to the portions of the receptacle 2 and the corresponding zones of the sheet 1.

The receptacle 2 comprises a base 3 in the form of a disc sector delimited by two lateral edges 5 and 7 and an edge 8 in the form of a circular arc. Perpendicularly relative to the plane of the base 3, the receptacle 2 comprises:

- a first lateral wall 9 and a second lateral wall 11 which extend along the rectilinear edges 5 and 7, and
- a curved wall which forms a projection 13 which extends along the edge 8 in the form of a circular arc.

The lateral walls 9 and 11 meet each other at a tip 15 opposite the projection 13.

The lateral walls 9 and 11 and the projection 13 are extended with flaps 17, 19 and 21, respectively, which are intended to be folded down along folding lines 23, 25 and 27, when the package is closed.

Before folding, the sheet 1 further comprises intermediate zones 29, 31 and 33 which are arranged between the walls 9 and 11 and the flaps 17 and 19 thereof, between the wall 9 and the projection 13 and the flaps 17 and 21 thereof, and between the projection 13 and the wall 11 and the flaps 21 and 19 thereof, respectively. The lateral edges 35 and 37 of the projection 13 and the flap 21 extend the lateral edges 5 and 7 of the base 3.

The sheet 1 is also provided, at the side which is intended to form the inner face of the receptacle 2, with two strips 51*a* and 51*b* for guiding tears. The sheet 1 and the strips 51*a* and 51*b* thus form a packaging element.

The two strips 51*a* and 51*b* are, for example, produced from polyethylene (PET) and have a thickness which is strictly less than 36 μm, for example, 23 μm or 18 μm. The strips 51*a* and 51*b* have been thermowelded both to each other and to the sheet 1.

As illustrated in FIG. 1, the first strip 51*a* comprises a main portion 52*a* which extends substantially parallel with and along the edge 5 which extends along the base 3.

The main portion 52*a* is extended, in the projection 13, with a first end 53*a* which is inclined, from the point of origin of the projection, relative to the edge 35 towards the centre axis A of the base 3. This inclination is, for example, 10°.

At the other side, the portion 52*a* is extended with a second end 55*a* which, in the example illustrated, is inclined by an angle α relative to the axis A. The angle α is, for example, between 15° and 25°.

This second end 55*b* extends slightly through the second lateral wall 11, then extends through the intermediate zone 29 and finally protrudes therefrom over a length l measured along the centre axis A of the base 3.

The second strip 51*b* has, in the region of the projection 13, a form which is symmetrical with respect to that of the first strip 51*a* relative to the centre axis A.

However, the main portion 52*b* of the strip 51*b* has a break 54*b* beyond which the main portion 52*b* is no longer substantially parallel with the edge 7 but instead intersects with it, so that the second end 55*b* of the strip 51*b* is located at the same side of the centre axis A as the end 55*a* of the strip 51*a*.

The main portions 52*a* and 52*b* meet each other at an intersection point 57 which is located, for example, in the intermediate zone 29. This intersection point 57 is laterally spaced-apart from the centre axis A.

Beyond the intersection point 57, the ends 55*a* and 55*b* of the strips 51*a* and 51*b* are superimposed, the end 55*b* being arranged below the end 55*a* and having the same shape as the end 55*a*.

The ends 55*a* and 55*b* are heat-sealed to each other and heat-sealed to the sheet 1. These two ends 55*a* and 55*b* therefore form a single traction tongue 58 which is laterally spaced-apart from the centre axis A and which protrudes from the intermediate zone 29 by the length l.

In the example illustrated, this tongue 58 is rectilinear and inclined by the angle α relative to the centre axis A.

In order to obtain the receptacle 2 of FIG. 2 from the sheet 1, the intermediate zones 31 and 33 which connect the lateral walls 9 and 11 and the projection 13 are folded from the base 3 at the centre thereof along the lines 59 and 61 which can be seen in FIG. 1. The triangular flaps 63 and 65 thus formed are folded respectively on the lateral walls 9 and 11 along the lateral edges 35 and 37 of the projection 13. With regard to the intermediate zone 29 which supports the ends 55*a* and 55*b* it is also folded at the centre thereof along a folding line 67 (FIG. 1) and the triangular flap 69 thus formed (FIG. 2) is folded along the tip 15 on the first lateral wall 9.

The traction tongue 58 protrudes upwards beyond the folding line 23 and therefore beyond the first lateral wall 9.

In the receptacle 2 which is thus obtained a pre-determined quantity of molten cheese is poured in the hot state to a depth which is equal to the height of the lateral walls 9 and 11 and the projection 13 in order to constitute a portion 70 which is visible in FIG. 2.

A second sheet 71 which has dimensions which correspond to those of the base 3, is deposited on the portion 70. This second sheet 71 is, for example, also produced from aluminium covered with heat-sealing lacquer. Then, as illustrated in FIG. 3, the flaps 17, 19 and 21 are folded down and sealed on the second sheet 71 in order to form a cover 72 opposite the base 3.

Figure 3:
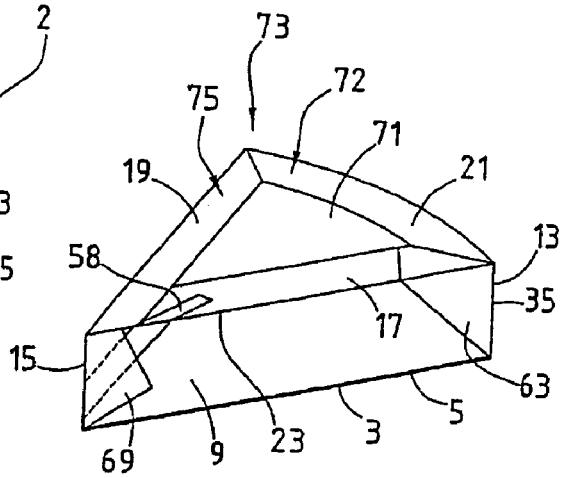
FIG. 3 is a schematic perspective illustration of the completed package.

As illustrated in FIG. 3, the tongue 58 can be folded down on the cover 72, for example, during the sealing of the cover 72. The tongue 58 thus forms a fold at right angles with the fold 23 which connects the first lateral wall 9 to the flap 17, without nonetheless being pressed or adhesively-bonded with respect to the flap 17.

The tongue 58 is not sealed to the cover 72 and can therefore be more readily gripped by a consumer, even if he has short nails.

If the tongue 58 is folded down during sealing, the heating of the tongue 58 and in particular the fold thereof, allows it to keep this shape after production.

An assembly 73 is thus obtained which comprises a package 75, formed from the sheets 1 and 71, and the portion of soft cheese 70 packaged in the package 75.

In a variant, the tongue 58 can be folded down on the cover 72 not when the cover is sealed, but instead when the assembly 73 is placed in a casing.

Figure 4:
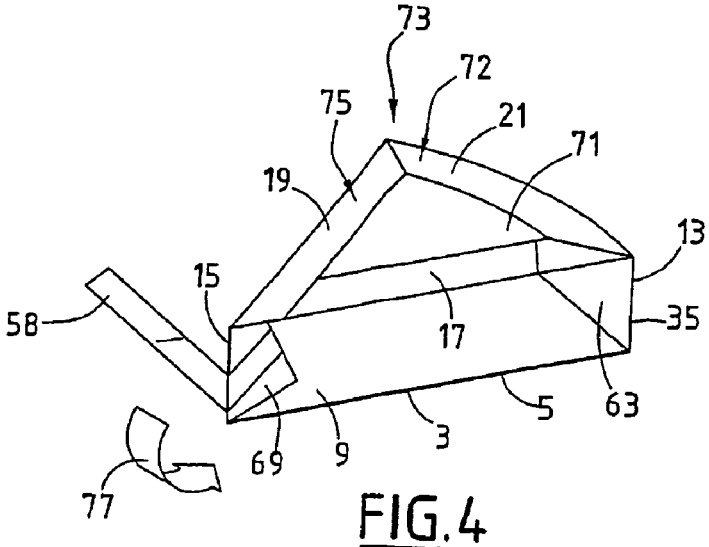
FIG. 4 is a schematic perspective view illustrating the beginning of the opening of the package of FIG. 3.

The package 75 is opened as illustrated in FIG. 4.

The consumer grips the tongue 58 which is not sealed to the flap 17, then applies a traction movement thereto which is directed towards the base 3 and the projection 13, as indicated by the arrow 77 in FIG. 4. The tongue 58 initiates tears substantially along the length of the tip 15, rather than unfolding the flap 69 as in the prior art.

Then, the traction continues in the same direction indicated by the arrow 77. The tears which are brought about substantially along the length of the tip 15 are propagated and guided along the edges 5 and 7 of the base 3. The remainder of the opening of the package 75 is carried out in conventional manner and is therefore not illustrated in the Figures.

Owing to the fact that the traction tongue 58 is spaced-apart from the centre axis A in the sheet 1, the initiation and the propagation of the tears does not involve any significant change in the traction direction as in FR-2 597 441. The opening is therefore logical and can be implemented by almost all consumers.

Owing to the existence of a single traction tongue 58 in the sheet 1 and not two tongues 58 which are arranged at one side and the other of the common axis and which are intended to be superimposed during the folding of the sheet 1, the risks of incorrectly gripping the traction tongue are reduced.

Furthermore, since the tongue 58 is folded down on the cover 72 in the packaging 75, the tongue is located and can be readily gripped by consumers. The tongue 58 was able to be folded down on the cover 72 since it protrudes beyond the first lateral wall 9 into the packaging 75.

In a variant, the tongue 58 may not be folded down or may not even protrude beyond the lateral wall 9. The tongue 58 is arranged along the first wall 9 as in the prior art.

In a variant, the tongue 58 may be formed by only one of the strips 51*a* and 51*b*.

In this manner, the second strip 51*b* may not have, beyond the intersection point 57, an end 55*b* which is superimposed on the end 55*a*. In yet another variant, the end 55*b* may not extend over the same length as the end 55*a*.

In yet other variants, the traction tongue 58 may have shapes other than those illustrated in FIGS. 1 to 4, and may, for example, not be rectilinear.

In the same manner, in a variant, the intersection point 57 may be located in the second wall 11 or in the base 3 close to the intersection between the edges 5 and 7.

Figure 5:
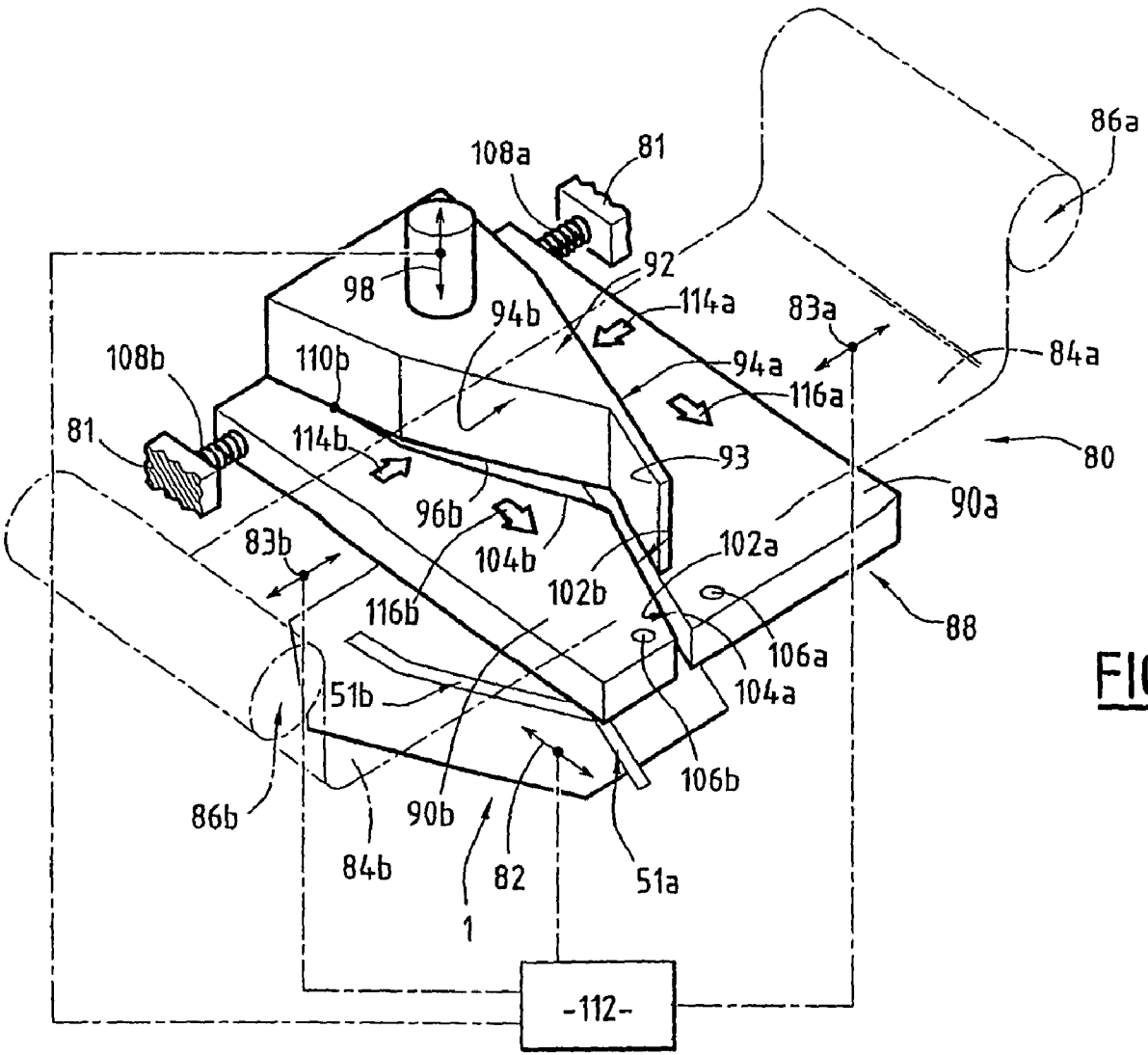
FIG. 5 is a schematic perspective illustration of an installation for cutting and sealing tear guiding members.

It is also possible, for example, for the strip 51*b* to have no break 54*b* in the main portion thereof, as illustrated in FIG. 5.

Furthermore, the strips 51*a* and 51*b* may be replaced with other forms of guiding means.

In this manner, these may be local weakenings of the first sheet 1 obtained, for example, by means a wheel or a laser beam.

Advantageously, the guiding strips 51*a* and 51*b* described above were obtained using an installation for cutting at least one film, as described below.

FIG. 5 illustrates an installation 80 for cutting and sealing guiding strips 51*a* and 51*b* on sheets 1 which have been cut beforehand.

The installation 80 comprises:

- a frame 81, only parts of which have been illustrated in FIG. 5,
- means 82 for feeding sheets 1, these sheets 1 being able to be cut or not in the installation 80,
- means 83*a* and 83*b* for feeding films 84*a* and 84*b* of the material which constitutes the strips 51*a* and 51*b*, these means allowing, for example, two rolls 86*a* and 86*b* of the films 84*a* and 84*b* to be unwound, and
- a device 88 for cutting the films 84*a* and 84*b*.

The feeding means 83*a* and 83*b* are, for example, of the conventional type and may thus comprise traction rollers, as illustrated in document FR-2 362 765.

They move the films 84*a* and 84*b* towards the blade 92 in a substantially horizontal manner.

In the same manner, the feeding means 82 may have a conventional structure.

The cutting device 88 comprises two lower blades 90*a* and 90*b* and an upper blade 92.

Figure 6:
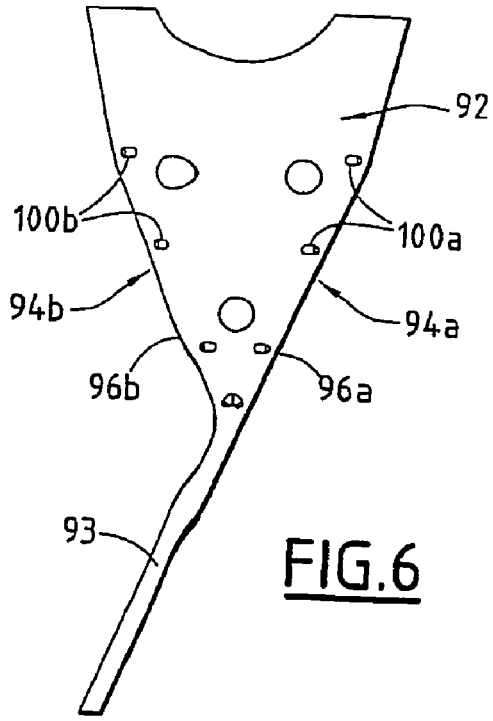
FIG. 6 is a plan view of one of the blades of the installation of FIG. 5.

As illustrated in FIG. 6, the upper blade 92, in the example illustrated, has a substantially triangular shape which is extended in the region of the tip thereof by a tail 93. The lateral sides 94*a* and 94*b* thereof which are directed towards the rollers 86*a* and 86*b*, respectively, have, for example, reliefs of approximately 1.5° relative to the vertical. The lower edges 96*a* and 96*b* of the sides 94*a* and 94*b* form cutting edges whose profiles correspond to the shapes of the guiding strips 51*a* and 51*b* to be cut, respectively.

The installation 80 comprises means 98 for moving the upper blade 92 relative to the frame 81 between an upper position which the blade 92 occupies before cutting and which is illustrated in FIG. 5, and a lower position which the blade 92 occupies after cutting the strips 51*a* and 51*b*.

In the upper position of the blade 92, the cutting edges 96*a* and 96*b* are located above the films 84*a* and 84*b*, respectively.

The cutting edges 96*a* and 96*b* are substantially horizontal and the movement of the blade 92 between the upper and the lower positions thereof is carried out in a substantially vertical manner, that is to say, substantially orthogonally relative to the plane of the films 84*a* and 84*b* when they are in the region of the upper blade 92.

As can be seen in FIG. 6, the blade 92 is perforated in the region of the lateral sides 94*a* and 94*b* thereof with apertures 100*a* and 100*b* for drawing in the cut strips 51*a* and 51*b*. These apertures are connected to a reduced pressure source which is not illustrated.

The lower blades 90*a* and 90*b* are arranged below the films 84*a* and 84*b*, respectively, at one side and the other of the upper blade 92. Their sides 102*a* and 102*b*, which face each other, have upper edges 104*a* and 104*b* which form cutting edges having shapes which complement those of the edges 96*a* and 96*b*.

The cutting edges 104*a* and 104*b* are arranged in the same plane which is slightly inclined relative to the horizontal, for example, by 5°.

The lower blades 90*a* and 90*b* can be moved on the frame 81 substantially parallel with the plane of the films 84*a* and 84*b* when they are in the region of the upper blade 92.

In the example illustrated, the lower blades 90*a* and 90*b* are articulated to the frame 81 by means of pivots 106*a* and 106*b*.

The blades 90*a* and 90*b* can thus be moved between a mutually close position and a mutually remote position, the path of this movement being small, for example, in the order of 0.5 mm.

The cutting device 88 comprises means 108*a* and 108*b* for resiliently returning the blades 90*a* and 90*b* to their mutually close position.

In the example illustrated, these means are springs which are arranged laterally at the outer side of the blades 90*a* and 90*b*, between the blades and the portions of the frame 81.

In other variants, these springs 108*a* and 108*b* may be replaced, for example, with a single spring 108 which connects the blades 90*a* and 90*b* to each other.

Preferably, these resilient return means can be adjusted.

Both in the upper position thereof, and in the lower position thereof, the upper blade 92 is interposed laterally between the lower blades 90*a* and 90*b*.

The return means 108*a* and 108*b* laterally press the blades 90*a* and 90*b* against the blade 92. In this manner, the cutting edges 104*a* and 104*b* are pressed against the cutting edges 96*a* and 96*b* substantially parallel with the plane of the films 84*a* and 84*b* in the region of the blade 92 at points of contact 110*a* and 110*b* (FIG. 5).

Furthermore, the installation 88 comprises an electronic control unit 112 for automatically controlling, in particular via the means 82, 83*a*, 83*b* and 98, the execution of the cutting cycle described below.

The upper blade 92 is initially in an upper position, the contact points 110*a* and 110*b* are remote from the tail 93 of the upper blade 92. The lower blades 90*a* and 90*b* are in a mutually close position.

Before the cutting operation itself begins, the feeding means 82 have placed a sheet 1 below the cutting device 88 and the feeding means 83*a* and 83*b* have caused the films 84*a* and 84*b* to move forward slightly so that a width which corresponds to that of the strips 51*a* and 51*b* extends from the cutting edges 104*a* and 104*b* laterally towards the upper blade 92.

The upper blade 92 is lowered and the contact points 110*a* and 110*b* move progressively towards the tail 93 of the upper blade 92.

The movement of the contact points 110*a* and 110*b* brings about the progressive cutting of the strips 51*a* and 51*b* which are retained by means of suction, as they are cut, below the upper blade 92 owing to the suction apertures 100*a* and 100*b*.

During this movement of the contact points 110*a* and 110*b*, the insertion of the blade 92 between the lower blades 90*a* and 90*b* brings about their movement towards the mutually remote position thereof.

Owing to the return means 108*a* and 108*b*, the blades 90*a*, 90*b* and 92 are retained in a state pressed one against the other in the region of the contact points 110*a* and 110*b* substantially perpendicularly relative to the general directions in which the cuts are propagated in the films 84*a* and 84*b*, thus producing a scissor type effect. The corresponding retention forces have been indicated by the arrows 114*a* and 114*b* in FIG. 5 and the general propagation directions of the cuts have been indicated by the arrows 116*a* and 116*b*.

Following the cutting operation, the upper blade 92 continues its path as far as the lower position in which it presses the cut strips 51*a* and 51*b* against the sheet 1.

Heating means which are arranged in the frame 81 below the sheet 1 allow the strips 51*a* and 51*b* to be heat-sealed to each other and to the sheet 1.

Then, the upper blade 92 returns to its upper position, a new sheet 1 is placed below the device 88 and the films 84*a* and 84*b* are each moved forward by a distance which corresponds to the width of the strips 51*a* and 51*b*.

The cutting and sealing cycle is automatically repeated under the action of the unit 112.

Owing to the scissor type effect described above, it was possible to find that the guiding strips 51*a* and 51*b* are not crumpled during the cutting operation. This remains true even if the films 84*a* and 84*b* have extremely small thicknesses, for example, in the order of 23 μm or 18 μm.

In this manner, the installation 80 of FIG. 5 allows strips 51*a* and 51*b* having a small thickness to be produced, which facilitates the folding of the traction tongue 58 on the cover 72 in the package 75 of FIG. 3.

More generally, and regardless of the type of package in which the cut strips are used, the installation 80 allows films 84*a* and 84*b* having smaller thicknesses to be used, which significantly reduces the costs associated with the production of the tear guiding strips.

It is therefore possible to use an installation which implements the scissor type effect described above in order to produce guiding strips having various forms.

In the same manner, the cutting installation 80 may cut only a single guiding strip and not two simultaneously as in the example described above.

In the example described above, the cutting device 88 is a module which may be disassembled from the frame 81 in order to be able to adjust the various elements and in particular the return means 108*a* and 108*b* thereof.

If there are a plurality of cutting devices 88 provided for the same installation 80, it is possible to adjust a device 88 whilst the other device 88 is installed and used in the installation 80.

More generally, the scissor type effect can be provided by displacing not the whole of one or more blades, but instead by deforming portions thereof.

Figure 7:
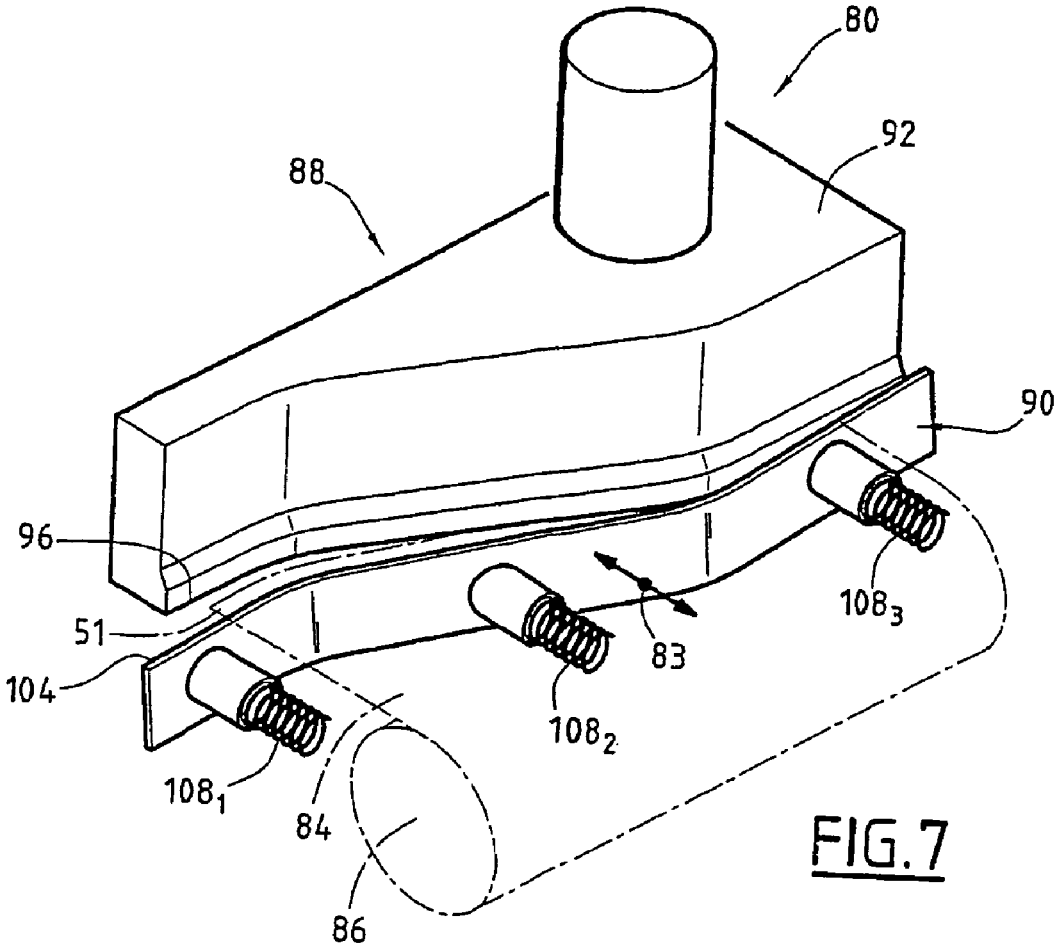
FIG. 7 is a perspective schematic illustration of a variant of the installation of FIG. 5.

This is illustrated in FIG. 7, in which the installation 80 further cuts only one strip 51.

The lower blade 90 is a blade which can be resiliently deformed in a horizontal manner.

In the example illustrated, resilient return means $\mathbf{108}_1$ to $\mathbf{108}_3$ are used to return the blade 90 against the upper blade 92. However, in yet another variant, the resilience of the lower blade 90 may be sufficient to dispense with means of this type and press the lower blade 90 against the upper blade 92. The blade 90 itself forms the resilient return means.

The invention claimed is:

1. Element for producing a package for packaging a food product, the element being of the type comprising:

a sheet which itself comprises:

a zone which is intended to form a substantially triangular base, the zone which is intended to form the base having a centre axis, two zones which are intended to form two lateral walls which are perpendicular relative to the base and which meet each other at a tip, a zone which is intended to form a projection opposite the tip and perpendicular relative to the base, an intermediate zone between the two zones which are intended to form the lateral walls, the intermediate zone being intended to form a flap which is folded along the tip against a first of the lateral walls; and means for guiding tears in the sheet, the guiding means extending substantially along lateral edges of the zone which is intended to form the base, the guiding means forming before folding a single traction tongue in order to bring about tears, the traction tongue extending through the intermediate zone and protruding beyond the sheet, wherein, in the intermediate zone, the traction tongue is spaced-apart a non-zero distance from the centre axis of the zone which is intended to form the base.

2. Element according to claim 1, wherein the traction tongue protrudes from the intermediate zone by a length which is adapted so that, in the package, the traction tongue protrudes beyond the first lateral wall.

3. Element according to claim 1, wherein the guiding means comprise two guiding strips which are attached to the sheet.

4. Element according to claim 3, wherein the traction tongue is formed by two superimposed ends of the guiding strips.

5. Element according to claim 3, wherein the guiding strips have thicknesses which are strictly less than 36 μm.

6. Element according to claim 3, wherein the guiding strips are produced from polyethylene.

7. Package for packaging a food product, comprising:

a first sheet, the first sheet being shaped in the form of a receptacle for receiving the food product and comprising a substantially triangular base which is bounded by two lateral walls which meet each other at a tip and a wall which forms a projection opposite the tip, the lateral walls and the projection being perpendicular relative to the base, the first sheet comprising a flap which is folded along the tip against a first of the lateral walls, the first sheet comprising means for guiding tears in order to allow the package to be opened, the guiding means extending substantially along lateral edges of the base and a traction tongue in order to bring about tears in the first sheet, the traction tongue extending into the flap and protruding beyond the flap, and a second sheet for covering the food product and closing the receptacle in order to form a cover opposite the base, wherein the first sheet is the element according to claim 1.

8. Package according to claim 7, wherein the traction tongue protrudes beyond the first lateral wall.

9. Package according to claim 8, wherein the traction tongue is folded down on the cover of the package.

10. Assembly comprising a package and a food product which is packaged in the package, wherein the package is a package according to claim 7.

11. Assembly according to claim 10, wherein the food product is soft cheese.

12. An element for producing a package for packaging a food product, the element comprising:

a sheet which comprises:

a first zone which is intended to form a substantially triangular base, the first zone having a centre axis, two zones which are intended to form two lateral walls which are perpendicular relative to the base and which meet each other at a tip, another zone which is intended to form a projection opposite the tip and perpendicular relative to the base, an intermediate zone between the two zones which are intended to form the lateral walls, the intermediate zone being intended to form a flap which is folded along the tip against a first of the lateral walls; and a tear guide that guides tears in the sheet, the tear guide extending substantially along lateral edges of the first zone, the tear guide forming before folding a single traction tongue in order to bring about tears, the traction tongue extending through the intermediate zone and protruding beyond the sheet, wherein, in the intermediate zone, the traction tongue is spaced-apart from the centre axis of the first zone by a non-zero angle.

13. The element as claimed in claim 12, wherein the non-zero angle is between 15° and 25°.

* * * * *